US007395146B2

(12) United States Patent
Ueda et al.

(10) Patent No.: US 7,395,146 B2
(45) Date of Patent: Jul. 1, 2008

(54) FUEL INJECTION CONTROL APPARATUS FOR INTERNAL COMBUSTION ENGINE

(75) Inventors: Koichi Ueda, Susono (JP); Kota Sata, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 123 days.

(21) Appl. No.: 10/592,382

(22) PCT Filed: Mar. 20, 2006

(86) PCT No.: PCT/JP2006/306053

§ 371 (c)(1),
(2), (4) Date: Sep. 12, 2006

(87) PCT Pub. No.: WO2006/109542

PCT Pub. Date: Oct. 19, 2006

(65) Prior Publication Data

US 2008/0103672 A1 May 1, 2008

(30) Foreign Application Priority Data

Mar. 30, 2005 (JP) ..... 2005-098799

(51) Int. Cl.
*F02D 41/06* (2006.01)
*F02D 41/14* (2006.01)

(52) U.S. Cl. ..... 701/103; 123/491

(58) Field of Classification Search ..... 701/103–105; 123/480, 491

See application file for complete search history.

(56) References Cited

U.S. PATENT DOCUMENTS 4,711,217 A 12/1987 Kano et al.
5,615,660 A * 4/1997 Iwano et al. ..... 123/680
6,360,160 B1 * 3/2002 Kanamaru et al. ..... 701/104
6,823,849 B2 11/2004 Ichinose et al.
6,959,242 B2 * 10/2005 Katoh et al. ..... 701/104
2005/0005899 A1 1/2005 Uchiyama et al.

FOREIGN PATENT DOCUMENTS

| | | |
|---|---|---|
| DE | 103 38 058 A1 | 12/2004 |
| EP | 0 889 224 A1 | 1/1999 |
| EP | 1 496 229 A2 | 1/2005 |
| JP | A 60-53647 | 3/1985 |
| JP | A 09-209805 | 8/1997 |
| JP | A 11-182292 | 7/1999 |
| JP | A 2003-138961 | 5/2003 |
| JP | A 2004-68621 | 3/2004 |

* cited by examiner

*Primary Examiner*—Hieu T Vo
(74) *Attorney, Agent, or Firm*—Oliff & Berridge, PLC

(57) ABSTRACT

An operating condition value is acquired at the time of internal combustion engine startup. If the acquired condition value is one of a plurality of reference condition values for which optimum values are defined, the optimum value for the reference condition value is set as a fuel injection amount. If, on the other hand, the acquired condition value is other than the reference condition values, an interpolated value, which is interpolation-calculated by using the relationship between the reference condition values and optimum values, is set as a fuel injection amount. The angular acceleration for fuel injection according to the interpolated value, which is a physical quantity related to the operating performance of an internal combustion engine, is then determined to correct the interpolated value in accordance with the difference between the actual angular acceleration and target angular acceleration.

7 Claims, 4 Drawing Sheets

FUEL INJECTION CONTROL APPARATUS FOR INTERNAL COMBUSTION ENGINE

DESCRIPTION

1. Technical Field

The present invention relates to a fuel injection control apparatus for an internal combustion engine, which determines a fuel injection amount for startup in accordance with predefined operating conditions.

2. Background Art

The operating performance characteristics of an internal combustion engine, such as the torque, fuel efficiency, and exhaust emission quality, greatly vary with the values of control parameters such as the fuel injection amount and ignition timing. Therefore, when an internal combustion engine is to be developed, the control parameter values are optimized to obtain optimum operating performance characteristics, for instance, by testing a real machine. The information concerning fuel injection amount setup for startup is set forth in Japanese Patent Laid-open No. 2004-68621. The fuel injection amount for startup is an important control parameter that determines, for instance, startability and exhaust emission quality. The technology described in Japanese Patent Laid-open No. 2004-68621 performs setup for the first cycle at the time of startup so that the fuel injection amount sequentially increases for the first to subsequent cylinders, and performs setup for the second and subsequent cycles so that the fuel injection amount sequentially decreases for the first to subsequent cylinders. Setup is also performed so that the fuel injection amount for each cylinder sequentially decreases for a predetermined number of cycles beginning with the first cycle.

The operating performance characteristics of an internal combustion engine not only vary with the control parameter values but also vary with the engine temperature and other operating conditions. When the fuel injection amount is fixed, the startability of an internal combustion engine is affected, for instance, by the engine temperature, intake air temperature, and. battery voltage. One way for constantly obtaining ideal startability irrespective of operating conditions would be to minutely preset an optimum fuel injection amount for each operating condition value. However, it takes an enormous amount of manpower to preset optimum values for all condition values so that a considerable amount of time and cost will be required for internal combustion engine development.

DISCLOSURE OF THE INVENTION

The present invention has been made to solve the above problem. It is an object of the present invention to provide an internal combustion engine control apparatus that determines the fuel injection amount for startup in accordance with the engine temperature and other predefined operating conditions, and makes it possible to inject an optimum amount of fuel according to an operating condition value without having to minutely preset an optimum fuel injection amount for each operating condition value.

The above object is achieved by a fuel injection control apparatus according to a first aspect of the present invention. The apparatus determines a fuel injection amount for startup in accordance with predefined operating conditions. The apparatus includes a storage unit for storing the relationship between a condition value for the operating conditions and an optimum fuel injection amount that is determined by using as an index a predefined physical quantity related to the operating performance of the internal combustion engine. The apparatus also includes a condition value acquisition unit for acquiring the condition value for the operating conditions when the internal combustion engine starts up. Further, a fuel injection amount setup unit and an interpolated value correction unit are provided. The fuel injection amount setup unit, when the acquired condition value is one of a plurality of reference condition values for which optimum values are predetermined, sets an optimum value predetermined for the reference condition value as a fuel injection amount, and when the acquired condition value is other than the reference condition values, sets as a fuel injection amount an interpolated value that is interpolation-calculated by using the relationship between the reference condition values and the optimum values. The interpolated value correction unit, when the acquired condition value is other than the reference condition values so, that the interpolated value is used as the fuel injection amount, determines the value of the predefined physical quantity prevailing when fuel is injected in accordance with the interpolated value, and corrects the interpolated value in accordance with a difference between a target value of the predefined physical quantity and an actual value of the predefined physical quantity.

When an operating condition value acquired at the time of startup is other than a reference condition value for which an optimum value is predefined, the first aspect of the present invention sets as a fuel injection amount an interpolated value that is interpolation-calculated by using the relationship between the reference condition values and the optimum values. If the actual value of the predefined physical quantity prevailing when fuel is injected in accordance with the interpolated value differs from a target value, the interpolated value is corrected in accordance with such a difference. Thus, even if no optimum value is predefined for the condition value, an optimum amount of fuel can be injected in order to obtain target operating performance characteristics of an internal combustion engine. In other words, the first aspect of the present invention can inject an optimum amount of fuel in accordance with a condition value even when an optimum fuel injection amount is not minutely preset for each operating condition value.

According to a second aspect of the present invention, the apparatus according to the first aspect of the present invention may further include a variation correction unit which determines the value of the predefined physical quantity of each cylinder when fuel is injected in accordance with a fuel injection amount that is set by the fuel injection amount setup unit, and when the actual value of the predefined physical quantity differs from the target value in any of a plurality of cylinders, corrects a control parameter for the affected cylinder so that the actual value approximates to the target value.

When the actual value of the predefined physical quantity, which is used as an optimum value index, differs from the target value in any cylinder due to the influence of unit-to-unit variation and aging, the second aspect of the present invention corrects the control parameter for the affected cylinder in such a manner as to adjust such a difference. Thus, the second aspect of the present invention provides robustness against unit-to-unit variation and aging.

According to a third aspect of the present invention, in the apparatus according to the first or second aspect of the present invention, the predefined physical quantity may be an angular acceleration of the internal combustion engine.

According to a fourth aspect of the present invention, in the apparatus according to the second aspect of the present invention, the control parameter may be the fuel injection amount for the affected cylinder.

According to a fifth aspect of the present invention, in the apparatus according to the second or fourth aspect of the present invention, the control parameter is the ignition timing for the affected cylinder.

BEST MODE FOR CARRYING OUT THE INVENTION

Figure 1:
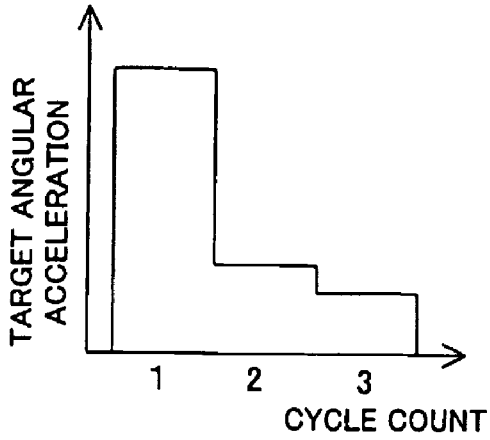
FIG. 1 is a graph illustrating typical target angular acceleration settings according to an embodiment of the present invention.

An embodiment of the present invention will now be described with reference to the accompanying drawings.

FIGS. 1 to 8 illustrate an internal combustion engine control apparatus according to an embodiment of the present invention. The internal combustion engine control apparatus according to the present embodiment is implemented as an ECU (Electronic Control Unit). The ECU stores data that is used to control an internal combustion engine. One of the data stored in the ECU indicates a fuel injection amount for internal combustion engine startup. The ECU exercises fuel injection control in accordance with a stored fuel injection amount for a predetermined number of injections or cycles at internal combustion engine startup, and then switches to normal fuel injection control, which is exercised in accordance with an intake air amount.

The startup fuel injection amount stored in the ECU is determined by performing a fuel injection amount optimization procedure on a real machine at an internal combustion engine development stage. An angular acceleration (crankshaft angular acceleration) of the internal combustion engine is a physical quantity that is related to the operating performance characteristics of the internal combustion engine. In the present embodiment, the angular acceleration is used as a quantitative index for fuel injection amount optimization purposes. More specifically, the average angular acceleration for a region between the compression TDC of each cylinder and an angle obtained by dividing an angle of 720° by the number of cylinders (a region between the compression TDC and BDC in the case of a four-cylinder engine) is used as an index for fuel injection amount optimization. It is assumed that the present embodiment optimizes the fuel injection amount for four-cylinder engine startup. The following advantage is provided when the average angular acceleration for the above-mentioned region is used as an index for fuel injection amount optimization.

When a motion equation is used, the indicated torque "Ti", which is generated on a crankshaft when combustion occurs in the internal combustion engine, can be calculated from Equations (1) and (2) below:

$$Ti=J\times(d\omega/dt)+Tf \quad (1)$$

$$Ti=Tgas+Tinertia \quad (2)$$

The right side of Equation (2) represents torque that generates the indicated torque "Ti". The right side of Equation (1) represents torque that consumes the indicated torque "Ti".

On the right side of Equation (1), "J" denotes the inertia moment of a drive member that is driven due to air-fuel mixture combustion; "dω/dt", crankshaft angular acceleration, and "Tf", drive section friction torque. "J×(dω/dt)" represents dynamic loss torque that results from the angular acceleration of the internal combustion engine. The friction torque "Tf" is torque that is generated due to mechanical friction between various mating parts such as friction between a piston and cylinder inner wall. It includes torque that is generated due to mechanical friction caused by auxiliaries. On the right side of Equation (2), "Tgas" denotes torque that is generated by in-cylinder gas pressure; and "Tinertia" denotes inertial torque that is generated by the reciprocating inertial mass of the piston and the like. The torque "Tgas" that is generated by the in-cylinder gas pressure is torque that is generated due to the combustion of injected fuel.

When fuel is injected from an injector and burned in a cylinder, torque is generated to vary the angular acceleration of the internal combustion engine. The angular acceleration change after each injection determines the post-startup rotation behavior of the internal combustion engine (the curve of the rotation speed with respect to time). Therefore, when the angular acceleration is used as an index for fuel injection amount optimization, it is conceivable that the fuel injection amount for obtaining ideal startability can be determined.

However, as is obvious from Equations (1) and (2), the internal combustion engine's angular acceleration "dω/dt" includes the influence of inertial torque "Tinertia" that is based on reciprocating inertial mass. The inertial torque "Tinertia" based on reciprocating inertial mass is irrelevant to the fuel injection amount and generated by the inertial mass of a piston or other reciprocating member. To accurately determine the fuel injection amount for obtaining ideal startability, therefore, it is necessary to eliminate the influence of inertial torque "Tinertia" based on reciprocating inertial mass from the angular acceleration "dω/dt", which is used as the index.

When attention is focused on a region between the TDC and BDC in a four-cylinder engine, which is equivalent to a crank angle of 180°, the average value of the inertial torque "Tinertia" based on the reciprocating inertial mass within the region is zero. Therefore, when the torque values in Equations (1) and (2) are calculated as the average value of the region between the TDC and BDC, the inertial torque "Tinertia" based on the reciprocating inertial mass can be calculated as zero. The influence of inertial torque "Tinertia", which is based on the reciprocating inertial mass, on the indicated torque "Ti" can then be eliminated. Further, the influence on the angular acceleration "dω/dt" can also be eliminated. In other words, when the average angular acceleration for the region between the TDC and BDC is used as an index for fuel injection amount optimization, it is possible to eliminate the influence of inertial torque based on the reciprocating inertial mass and accurately determine the fuel injection amount for obtaining ideal startability.

In an actual optimization procedure, the target angular acceleration (the target angular acceleration value for the region between the TDC and BDC) for each cycle is first set as indicated in FIG. 1. The target angular acceleration should be set in accordance with a desired post-start rotation characteristic (e.g., facilitating or suppressing the buildup of engine speed). The target angular acceleration can be set for each injection as well as for each cycle.

Figure 2:
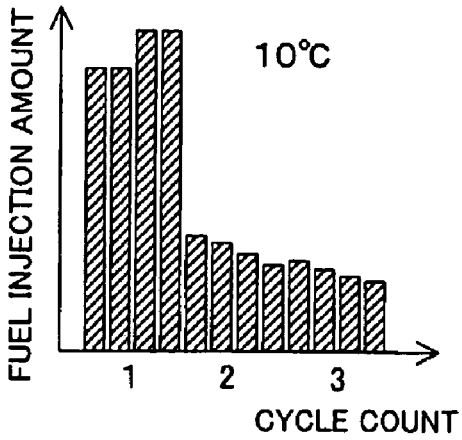
FIG. 2 is a graph illustrating typical optimum fuel injection amount settings for an engine temperature of 10° C.
Figure 3:
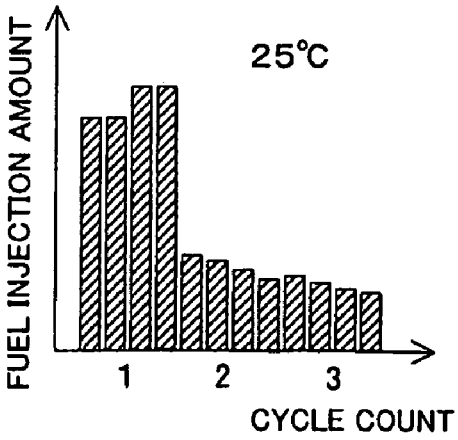
FIG. 3 is a graph illustrating typical optimum fuel injection amount settings for an engine temperature of 10° C.

After target angular acceleration setup, the fuel injection amount for attaining the target angular acceleration is searched for on an individual injection basis. In such an instance, the engine temperature and other operating condition values are maintained constant. After an optimum fuel injection amount is determined while a constant condition value (e.g., an engine temperature of 10° C.) is used as indicated in FIG. 2, an optimum fuel injection amount is determined while another condition value (e.g., an engine temperature of 25° C.) is used as indicated in FIG. 3. However, this optimization sequence is not performed for all possible condition values under the operating conditions, but performed for a plurality of preselected condition values (reference condition values) only.

Figure 4:
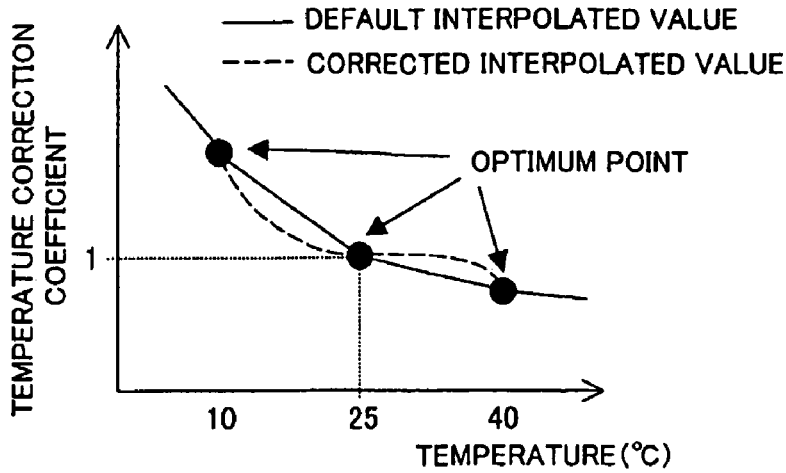
FIG. 4 shows a map from which a temperature correction coefficient value is read according to an engine temperature.

When the optimization procedure is completed for all reference condition values, a map is created in accordance with the results of optimization. The map in FIG. 4 shows an optimum value obtained at 25° C. as a reference fuel injection amount, and the ratios between the reference fuel injection amount and the optimum values obtained at reference engine temperatures (10° C., 25° C., and 40° C.). When the reference fuel injection amount is multiplied by a ratio indicated in the map, which is used as a temperature correction coefficient, the fuel injection amount for each reference engine temperature can be calculated. In the present embodiment, the ECU stores the map shown in FIG. 4 as the fuel injection amount data for internal combustion engine startup.

When the internal combustion engine starts up, the ECU measures the engine temperature by using a signal from a water temperature sensor. If the measured engine temperature coincides with one of the reference engine temperatures, the ECU accesses the map and reads a temperature correction coefficient value according to that reference engine temperature. The ECU multiplies the reference fuel injection amount by the read temperature correction coefficient, and sets the resulting value as the fuel injection amount. If, on the other hand, the measured engine temperature is other than the reference engine temperatures, the ECU calculates an interpolated value, which is derived from interpolation calculations, as the temperature correction coefficient for the measured engine temperature. As indicated by a solid line in FIG. 4, the present embodiment performs interpolation calculations on the assumption that the relationship between the engine temperature and temperature correction coefficient is linear for neighboring reference engine temperatures. The reference fuel Injection amount is then multiplied by the calculated temperature correction coefficient. Next, the resulting value is set as the fuel injection amount for the engine temperature.

As described above, when the measured engine temperature is other than the reference engine temperatures, the fuel injection amount is determined by performing interpolation calculations on the temperature correction coefficient. This makes it possible to provide an appropriate fuel injection amount for an engine temperature without having to minutely set an optimum fuel injection amount for each engine temperature. In other words, it is possible to reduce the manpower requirements for optimization by decreasing the number of optimization points.

Although the number of optimization points can be reduced, the fuel injection amount derived from interpolation calculations may cause the actual angular acceleration to differ from the target angular acceleration when fuel is actually injected in accordance with that fuel injection amount. The reason is that the actual relationship between the engine temperature and temperature correction coefficient is not always linear although the interpolation calculations are performed on the assumption that the relationship is linear. If the actual angular acceleration differs from the target angular acceleration, a desired rotation characteristic cannot be obtained. In such an instance, the startup rotation characteristic varies depending on the difference in the engine temperature.

Figure 5:
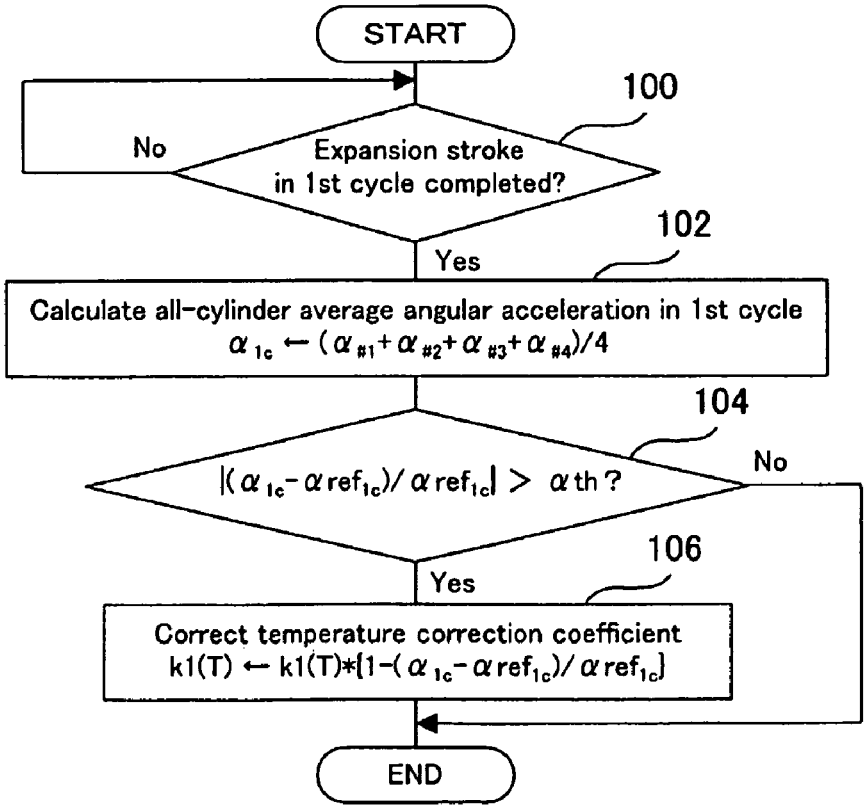
FIG. 5 is a flowchart illustrating a temperature correction coefficient correction routine that is executed by an embodiment of the present invention.

To prevent the startup rotation characteristic from varying depending on the engine temperature, the ECU corrects the temperature correction coefficient in accordance with a flowchart in FIG. 5 when the engine temperature is other than the reference engine temperatures. The flowchart in FIG. 5 illustrates a temperature correction coefficient correction routine that the ECU executes as the internal combustion engine's fuel injection control apparatus. When startup is accomplished by turning ON an ignition switch, the ECU measures the engine temperature. The ECU executes the correction routine shown in FIG. 5 only when the measured engine temperature does not coincide with any reference engine temperature.

Within the routine shown in FIG. 5 the first step (step 100) is performed to judge whether the expansion stroke in the first cycle is completed for all cylinders. A standby state prevails until the expansion stroke is completed for all cylinders. When the expansion stroke is completed for all cylinders, the flow proceeds to step 102. In step 102, the average angular acceleration for the region between the TDC and BDC is calculated for each cylinder. Next, the average value (all-cylinder average angular acceleration) "$\alpha_{1c}$" of the average angular accelerations "$\alpha_{\#1}$", "$\alpha_{\#2}$", "$\alpha_{\#3}$", "$\alpha_{\#4}$, for individual cylinders is calculated.

Next, step 104 is performed to check whether the all-cylinder average angular acceleration "$\alpha_{1c}$", which was calculated in step 102, is outside the range of permissible deviation from a first-cycle target angular acceleration "$\alpha ref_{fc}$". More specifically, this check is performed by judging whether the absolute value of a value that is obtained by dividing the deviation between the all-cylinder average angular acceleration "$\alpha_{1c}$" and the target angular acceleration "$\alpha ref_{1c}$" by the target angular acceleration "$\alpha ref_{1c}$" is greater than a predetermined judgment standard value. If the obtained judgment result indicates that the all-cylinder average angular acceleration "$\alpha_{1c}$" is within the range of permissible deviation, the routine terminates without correcting the temperature correction coefficient "K1(T)".

If, on the other hand, the judgment result obtained in step 104 indicates that the all-cylinder average angular acceleration "$\alpha_{1c}$" is outside the range of permissible deviation, the routine performs step 106. In step 106, the temperature correction coefficient "k1(T)" is corrected in accordance with the deviation of the all-cylinder average angular acceleration "$\alpha_{1c}$" from the target angular acceleration "$\alpha ref_{1c}$" indicated in Equation (3) below. In Equation (3), "k1(T)old" on the right side denotes an uncorrected temperature correction coefficient, and "k1(T)new" on the left side denotes a corrected temperature correction coefficient.

$$k1(T)\text{new}=k1(T)\text{old}\times\{1-(\alpha_{1c}-\alpha ref_{1c})/\alpha ref_{1c}\} \quad (3)$$

As indicated by a broken line in FIG. 4, the ECU learns the temperature correction coefficient corrected by the above routine as a temperature correction coefficient for the engine temperature. The next time the same temperature condition is established, the fuel injection amount is set by using the learned temperature correction coefficient. This ensures that an optimum amount of fuel can be injected to obtain a desired rotation characteristic even when no optimum value is predefined for the engine temperature. In other words, the internal combustion engine control apparatus according to the present embodiment makes it possible to inject an optimum amount of fuel in accordance with the engine temperature prevailing at startup even when the optimum fuel injection amount is not minutely predefined for each engine temperature, which is a part of the operating conditions.

In the present embodiment, the "storage unit" according to the present invention is implemented when the ECU stores the map shown in FIG. 4. Further, the "condition value acquisition unit" according to the present invention is implemented when the ECU measures the engine temperature at startup. Furthermore, the "fuel injection amount setup unit" according to the present invention is implemented when the ECU uses the map shown in FIG. 4 to set a fuel injection amount appropriate for the engine temperature. In addition, the "interpolated value correction unit" according to the present invention is implemented when the ECU executes the routine shown in FIG. 5.

The development engine used for fuel injection amount optimization has the same structure as mass-produced engines. Theoretically, an ideal rotation characteristic can therefore be obtained for mass-produced engines when a fuel injection amount for obtaining an ideal rotation characteristic is set as an optimum value for the development engine. However, the internal combustion engine varies from one unit to another. Therefore, even when the optimum value is used as a fuel injection amount, an ideal rotation characteristic is not always obtained for all units of the internal combustion engine. Further, the rotation characteristic may deviate from an ideal one due to aging.

Figure 6:
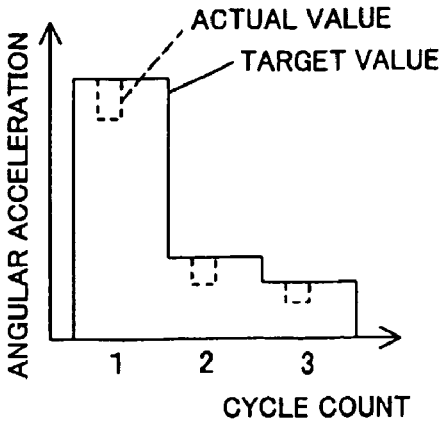
FIG. 6 is a graph illustrating angular acceleration behavior in an actual internal combustion engine.
Figure 7:
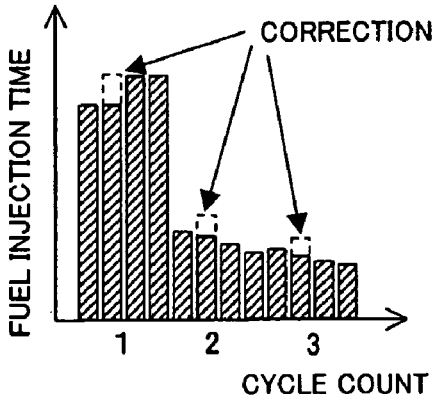
FIG. 7 is a graph illustrating optimum fuel injection amount settings corrected in accordance with the actual angular acceleration behavior shown in FIG. 6.

In an internal combustion engine whose startup rotation characteristic differs from an ideal one, there is a difference between the actual angular acceleration and target angular acceleration in a particular cylinder as indicated in FIG. 6. Such an angular acceleration discrepancy may occur in a particular cylinder if, for instance, the flow rate of an injector for a particular cylinder is lower than that of the injectors for the other cylinders. In such a situation, it is conceivable that an ideal rotation characteristic can be obtained for the internal combustion engine when the fuel injection amount (optimum value) for the particular cylinder having an improper angular acceleration is corrected in accordance with the difference between the actual angular acceleration and target angular acceleration as indicated in FIG. 7.

Figure 8:
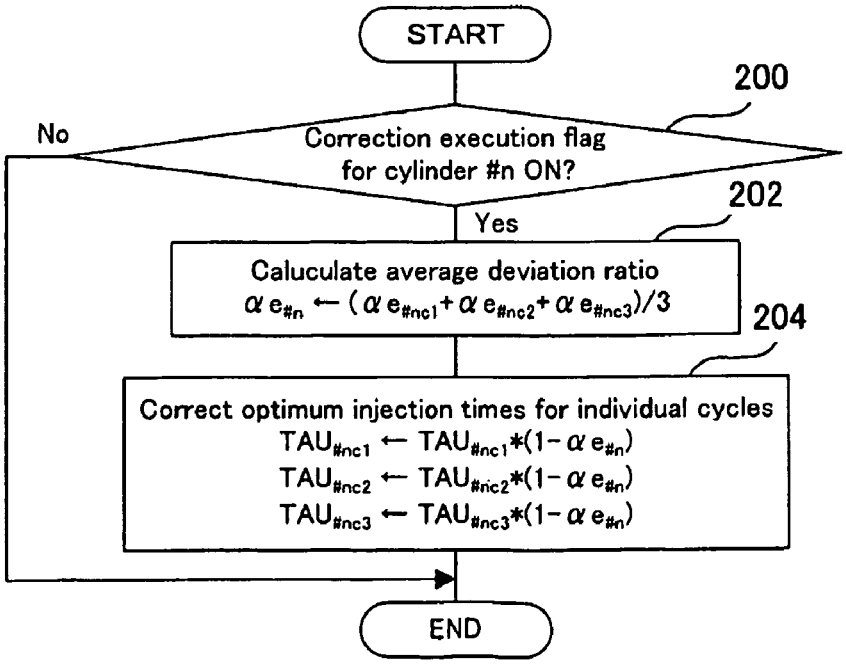
FIG. 8 is a flowchart illustrating an optimum value correction routine that is executed by an embodiment of the present invention.

Therefore, if the angular acceleration for a particular cylinder is improper, the ECU corrects the optimum value for the fuel injection amount (fuel injection time) for the particular cylinder in accordance with a flowchart in FIG. 8. The flowchart in FIG. 8 illustrates an optimum value correction routine that the ECU according to the present embodiment executes as the internal combustion engine's fuel injection control apparatus. The correction routine shown in FIG. 8 is executed after the fuel injection control mode switches from optimum-value-based fuel injection control to normal fuel injection control, which is based on the intake air amount. It is assumed herein that optimum-value-based fuel injection control is exercised during the first to third cycles after startup.

Within the routine shown in FIG. 8, the first step (step 200) is performed to judge whether a correction execution flag is ON for any cylinder. While optimum-value-based fuel injection control is exercised, the ECU measures the angular acceleration (the average angular acceleration for a region between the TDC and BDC) on an individual cylinder basis and on an individual cycle basis. The ECU then compares the measured actual angular acceleration against the target angular acceleration on an individual cylinder basis. If, in a certain cylinder, the difference between the actual angular acceleration and target angular acceleration is outside a predetermined acceptable range, the ECU turns ON the correction execution flag for that cylinder.

If the judgment result obtained in step 200 indicates that the correction execution flag is ON for a particular cylinder (cylinder #n), the next step (step 202) is performed to calculate the deviation ratio of the actual angular acceleration of the particular cylinder to the target angular acceleration on an individual cycle basis. Then, the average value (average deviation ratio) "$\alpha e_{\#n}$" of the deviation ratios "$\alpha e_{\#nc1}$", $\alpha e_{\#nc2}$", $\alpha e_{\#nc3}$" of the individual cycles is calculated.

In the next step (step 204), the optimum fuel injection amount for the particular cylinder is corrected on an individual cycle basis by using the average deviation ratio "$\alpha e_{\#n}$" calculated in step 202. The fuel injection amount is determined by the injection operation time, that is, the fuel injection time. Therefore, it is assumed herein that the fuel injection time (optimum injection time) for the optimum fuel injection amount is corrected. The optimum injection time is corrected as indicated in Equation (4) below. In Equation (4), "$TAU_{\#n}$old" on the right side denotes an uncorrected optimum injection time for the particular cylinder, and "$TAU_{\#n}$new" on the left side denotes a corrected optimum injection time.

$$TAU_{\#n}\text{new}=TAU_{\#n}\text{old}\times(1-\alpha e_{\#n}) \quad (4)$$

The ECU corrects the optimum injection times "$TAU_{\#nc1}$", "$TAU_{\#nc2}$", "$TAU_{\#nc3}$" for the individual cycles by using Equation (4) above, and stores the corrected optimum injection times "$TAU_{\#nc1}$", "$TAU_{\#nc2}$", "$TAU_{\#nc3}$". The next time the internal combustion engine is to be started, fuel injection control is exercised for the particular cylinder in accordance with the currently learned optimum injection times "$TAU_{\#nc1}$", "$TAU_{\#nc2}$", "$TAU_{\#nc3}$". This adjusts the difference between the actual angular acceleration for the particular cylinder and the target angular acceleration, which has arisen due to unit-to-unit variation and aging. As described above, the internal combustion engine control-apparatus according to the present embodiment provides robustness against unit-to-unit variation and aging, and maintains an ideal rotation characteristic for the internal combustion engine.

In the present embodiment, the "variation correction unit" according to the present invention is implemented when the ECU executes the routine shown in FIG. 8.

While the present invention has been described in terms of a preferred embodiment, it should be understood that the invention is not limited to the preferred embodiment, and that variations may be made without departure from the scope and spirit of the invention. For example, the following modifications may be made to the preferred embodiment of the present invention.

In the embodiment described above, the temperature correction coefficient is corrected in accordance with the difference between the first cycle's all-cylinder average angular acceleration and the target angular acceleration. Alternatively, the temperature correction coefficient may be corrected in accordance with the difference between the all-cylinder average angular acceleration for all cycles (first to third cycles) and the target angular acceleration. Further, another alternative is to calculate the all-cylinder average angular acceleration after the engine is started a predetermined number of times at the same temperature and correct the temperature correction coefficient upon the calculation instead of calculating the all-cylinder average angular acceleration at each internal combustion engine startup and correcting the temperature correction coefficient upon each calculation.

The temperature correction coefficient can be set for each cycle or cylinder. In such an instance, the angular acceleration is measured for each cycle or cylinder, and compared against a target angular acceleration that is set for each cycle or cylinder. If the measured angular acceleration is outside the range of permissible deviation from the target angular acceleration, the temperature correction coefficient, which is set for each cycle or cylinder, is corrected in accordance with the amount of deviation.

The embodiment described above determines the optimum fuel injection amount in accordance with the engine temperature. The optimum fuel injection amount may also be determined in accordance with the battery voltage, intake air temperature, and other operating conditions. In such a case, the optimum value need not be determined for all condition values. The optimum value should be determined for a predefined reference condition value only. For a condition value other than the reference condition value, the correction coefficient appropriate for the condition value should be determined by performing interpolation calculations. The angular acceleration prevailing when fuel is injected in accordance with the determined correction coefficient should then be measured. Further, the correction coefficient should be corrected in accordance with the difference between the actual angular acceleration and target angular acceleration.

The embodiment described above compares the actual angular acceleration against the target angular acceleration on an individual cylinder basis, and corrects the fuel injection amount (fuel injection time) for a cylinder in which the difference between the actual angular acceleration and target angular acceleration is outside a predefined acceptable range. An alternative is to determine the difference between the all-cylinder average angular acceleration and target angular acceleration and uniformly correct the fuel injection amount for all cylinders in accordance with the determined difference.

When an angular acceleration discrepancy is found in a particular cylinder, the embodiment described above corrects the fuel injection amount (fuel injection time) for the particular cylinder. However, some other control parameter value related to the torque of the particular cylinder may alternatively be corrected. When, for instance, the ignition timing is corrected, the torque of the particular cylinder varies to adjust the angular acceleration.

Figure 9:
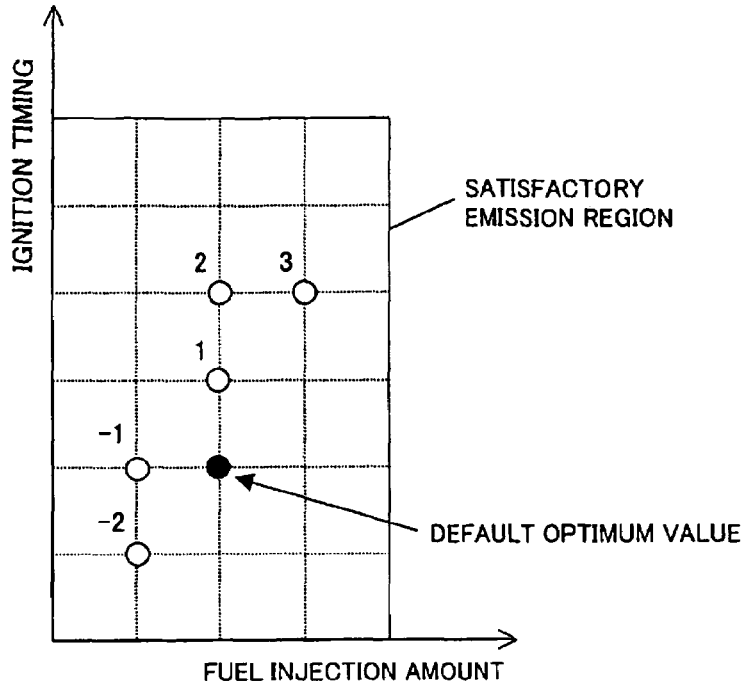
FIG. 9 shows a map for correcting the optimum fuel injection amount and ignition timing.

FIG. 9 shows a map for correcting the optimum fuel injection amount and ignition timing. The map shown in FIG. 9 defines a satisfactory emission region in which the exhaust emission quality is maintained high. As indicated by a black circle that is within the illustrated satisfactory emission region, the initial optimum values are defined for the fuel injection amount and ignition timing (advance angle from the TDC). The larger the fuel injection amount and the earlier the ignition timing, the higher the angular acceleration. Therefore, the angular acceleration can be increased by increasing the fuel injection amount from its initial optimum value or by advancing the ignition timing. Conversely, the angular acceleration can be decreased by decreasing the fuel injection amount from its initial optimum value or by retarding the ignition timing. Within the figure, white circles (optimum points) with a positive number represent an optimum value combination of fuel injection amount and ignition timing for a corrective increase in the angular acceleration. On the other hand, white circles with a negative number represent an optimum value combination of fuel injection amount and ignition timing for a corrective decrease in the angular acceleration. When the numerical value for the selected optimum point increases, the angular acceleration increases to lower the exhaust emission quality.

Figure 10:
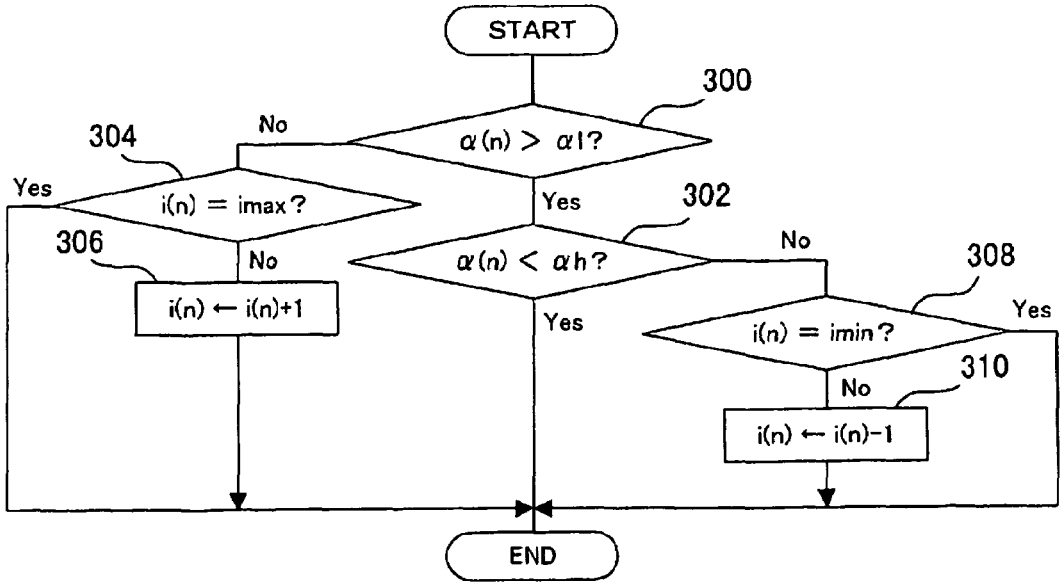
FIG. 10 is a flowchart illustrating a routine that is executed to select optimum values for fuel injection amount and ignition timing from the map shown in FIG. 9.

FIG. 10 is a flowchart illustrating a routine that is executed to select optimum values for fuel injection amount and ignition timing from the map shown in FIG. 9. The routine shown in FIG. 10 may be executed for each injection while optimum-value-based fuel injection control is exercised or executed after fuel injection control mode switching from optimum-value-based fuel injection control to normal fuel injection control based on the intake air amount.

Within the routine shown in FIG. 10, the first step (step 300) is performed to measure the angular acceleration (average angular acceleration for a region between the TDC and BDC) "$\alpha(n)$" after the nth injection, and then compare the measured value "$\alpha(n)$" against a predetermined threshold value "$\alpha(n)$". This threshold value "$\alpha l$" is a lower-limit value for the angular acceleration "$\alpha(n)$" that provides an ideal rotation characteristic, and is predefined for each injection. If the angular acceleration "$\alpha(n)$" is not greater than the threshold value "$\alpha l$", step 304 is performed to judge whether an index "i(n)" is equal to a maximum value "imax". The index "i(n)" correlates to a numerical value that is attached to an optimum point (white circle) in FIG. 9. In FIG. 9, the maximum value "imax" is 3. If the index "i(n)" is equal to the maximum value "imax", the value of the index "i(n)" remains equal to the maximum value "imax". If the index "i(n)" is smaller than the maximum value "imax", the next step (step 306) is performed to increment the value of the index "i(n)" by one.

If the judgment result obtained in step 300 indicates that the angular acceleration "$\alpha(n)$" is greater than the threshold value "$\alpha l$", the next step (step 302) is performed to compare the angular acceleration "$\alpha(n)$" against a predetermined threshold value "ah". Threshold value "$\alpha h$" is a higher-limit value for the angular acceleration "$\alpha(n)$" that provides an ideal rotation characteristic. It is greater than threshold value "$\alpha l$" and predefined for each injection. If the angular acceleration "$\alpha(n)$" is not smaller than threshold value "$\alpha h$", step 308 is performed to judge whether the index "i(n)" is equal to a minimum value "imin". In FIG. 9, the minimum value "imin" is −2. If the index "i(n)" is equal to the minimum value "imin", the value of the index "i(n)" remains equal to the minimum value "imin". If the index "i(n)" is greater than the minimum value "imin", the next step (step 310) is performed to decrement the value of the index "i(n)" by one.

If the judgment result obtained in step 302 indicates that the angular acceleration "$\alpha(n)$" is smaller than threshold value "$\alpha h$", that is, within an acceptable range, the current value of the index "i(n)" is maintained.

In accordance with the value of the index "i(n)", which is determined when the above routine is executed, the ECU selects optimum values for fuel injection amount and ignition timing from the map shown in FIG. 9 and exercises fuel injection control and ignition timing control in compliance with the selected optimum values. When the ignition timing is also used as a control parameter in addition to the fuel injection amount as described above, the satisfactory emission region can be effectively used in marked contrast to a case where only the fuel injection amount is used as a control parameter. This makes it possible to correct the difference between the actual angular acceleration and target angular acceleration for a specific cylinder while minimizing the degree of exhaust emission quality deterioration.

The invention claimed is:

1. A fuel injection control apparatus for an internal combustion engine, which determines a fuel injection amount for startup in accordance with predefined operating conditions, the apparatus comprising:

storage means for storing the relationship between a condition value for the operating conditions and an optimum fuel injection amount that is determined by using as an index a predefined physical quantity related to the operating performance of the internal combustion engine;

condition value acquisition means for acquiring the condition value for the operating conditions when the internal combustion engine starts up;

fuel injection amount setup means, which, when the acquired condition value is one of a plurality of reference condition values for which optimum values are predetermined, sets an optimum value predetermined for the reference condition value as a fuel injection amount, and when the acquired condition value is other than the reference condition values, sets as a fuel injection amount an interpolated value that is interpolation-calculated by using the relationship between the reference condition values and the optimum values; and interpolated value correction means, which, when the acquired condition value is other than the reference condition values so that the interpolated value is used as the fuel injection amount, determines the value of the predefined physical quantity prevailing when fuel is injected in accordance with the interpolated value, and corrects the interpolated value in accordance with a difference between a target value of the predefined physical quantity and an actual value of the predefined physical quantity.

2. The fuel injection control apparatus according to claim 1, further comprising:

variation correction means, which determines the value of the predefined physical quantity of each cylinder when fuel is injected in accordance with a fuel injection amount that is set by the fuel injection amount setup means, and when the actual value of the predefined physical quantity differs from the target value in any of a plurality of cylinders, corrects a control parameter for the affected cylinder so that the actual value approximates to the target value.

3. The fuel injection control apparatus according to claim 2, wherein the control parameter is the fuel injection amount for the affected cylinder.

4. The fuel injection control apparatus according to claim 2, wherein the control parameter is the ignition timing for the affected cylinder.

5. The fuel injection control apparatus according to claim 1, wherein the predefined physical quantity is an angular acceleration of the internal combustion engine.

6. A fuel injection control apparatus for an internal combustion engine, which determines a fuel injection amount for startup in accordance with predefined operating conditions, the apparatus comprising:

a storage unit for storing the relationship between a condition value for the operating conditions and an optimum fuel injection amount that is determined by using as an index a predefined physical quantity related to the operating performance of the internal combustion engine;

a condition value acquisition unit for acquiring the condition value for the operating conditions when the internal combustion engine starts up;

a fuel injection amount setup unit, which, when the acquired condition value is one of a plurality of reference condition values for which optimum values are predetermined, sets an optimum value predetermined for the reference condition value as a fuel injection amount, and when the acquired condition value is other than the reference condition values, sets as a fuel injection amount an interpolated value that is interpolation-calculated by using the relationship between the reference condition values and the optimum values; and an interpolated value correction unit, which, when the acquired condition value is other than the reference condition values so that the interpolated value is used as the fuel injection amount, determines the value of the predefined physical quantity prevailing when fuel is injected in accordance with the interpolated value, and corrects the interpolated value in accordance with a difference between a target value of the predefined physical quantity and an actual value of the predefined physical quantity.

7. The fuel injection control apparatus according to claim 6, further comprising:

a variation correction unit, which determines the value of the predefined physical quantity of each cylinder when fuel is injected in accordance with a fuel injection amount that is set by the fuel injection amount setup unit, and when the actual value of the predefined physical quantity differs from the target value in any of a plurality of cylinders, corrects a control parameter for the affected cylinder so that the actual value approximates to the target value.

* * * * *